US008985085B2

(12) United States Patent
Gekht et al.

(10) Patent No.: US 8,985,085 B2
(45) Date of Patent: Mar. 24, 2015

(54) OIL SEAL ARRANGEMENT FOR ROTARY INTERNAL COMBUSTION ENGINE

(75) Inventors: Eugene Gekht, Brossard (CA); Sebastien Bolduc, Longueuil (CA); Mike Fontaine, Boucherville (CA)

(73) Assignee: Pratt & Whitney Canada Corp., Longueuil, Quebec ( * ) Notice: Subject to any disclaimer, the term of this patent is extended or adjusted under 35 U.S.C. 154(b) by 247 days.

(21) Appl. No.: 13/271,883

(22) Filed: Oct. 12, 2011

(65) Prior Publication Data

US 2013/0028771 A1 Jan. 31, 2013

Related U.S. Application Data

(60) Provisional application No. 61/512,463, filed on Jul. 28, 2011.

(51) Int. Cl.

| | |
|---|---|
| ***F02B 53/00*** | (2006.01) |
| ***F01C 1/02*** | (2006.01) |
| ***F01C 19/00*** | (2006.01) |
| ***F01C 1/00*** | (2006.01) |
| ***F01C 1/22*** | (2006.01) |
| ***F01C 19/08*** | (2006.01) |
| ***F01C 21/08*** | (2006.01) |

(52) U.S. Cl.

CPC . *F01C 19/00* (2013.01); *F01C 1/00* (2013.01); *F01C 1/22* (2013.01); *F01C 19/005* (2013.01); *F01C 19/08* (2013.01); *F01C 21/08* (2013.01)

USPC ..... 123/200; 418/61.2

(58) Field of Classification Search

USPC ..... 418/61.2, 142; 277/500, 551, 586–589, 277/616, 630, 637; 123/200

See application file for complete search history.

(56) References Cited

U.S. PATENT DOCUMENTS

| | | | | | |
|---|---|---|---|---|---|
| 2,979,042 | A | | 4/1961 | Bentele | |
| 3,033,180 | A | | 5/1962 | Bentele | |
| 3,059,937 | A | * | 10/1962 | Wettstein | 277/587 |
| 3,102,518 | A | | 9/1963 | Anderson | |
| 3,102,520 | A | | 9/1963 | Schlör | |
| 3,134,337 | A | | 5/1964 | Paschke | |
| 3,134,537 | A | | 5/1964 | Bentele et al. | |
| 3,134,600 | A | | 5/1964 | Fisch | |
| 3,139,233 | A | | 6/1964 | Simonsen | |
| 3,142,439 | A | | 7/1964 | Froede | |
| 3,180,562 | A | | 4/1965 | Bentele | |
| 3,196,849 | A | | 7/1965 | Paschke | |
| 3,246,636 | A | | 4/1966 | Bentele | |
| 3,261,542 | A | * | 7/1966 | Jones | 418/61.2 |
| 3,300,127 | A | * | 1/1967 | Yamamoto et al. | 418/61.2 |
| 3,323,712 | A | * | 6/1967 | Froede et al. | 418/61.2 |
| 3,535,061 | A | * | 10/1970 | Yamamoto | 418/142 |

(Continued)

FOREIGN PATENT DOCUMENTS

| | | |
|---|---|---|
| EP | 2497902 | 9/2012 |

*Primary Examiner* — Thai Ba Trieu
*Assistant Examiner* — Ngoc T Nguyen
(74) *Attorney, Agent, or Firm* — Norton Rose Fulbright Canada

(57) ABSTRACT

A rotor of a rotary internal combustion engine, including an annular oil seal assembly snugly received within each oil seal groove, each oil seal assembly including a seal ring retaining first and second axially spaced apart annular sealing elements in substantial radial alignment with one another, the seal ring radially pressing each of the sealing elements in sealing engagement with a respective surface in the groove in opposite directions from one another, and a spring member biasing the seal ring axially away from the end face.

20 Claims, 3 Drawing Sheets

(56) References Cited

U.S. PATENT DOCUMENTS

| | | | | | |
|---|---|---|---|---|---|
| 3,575,541 | A | * | 4/1971 | Hamada | 418/142 |
| 3,656,764 | A | | 4/1972 | Robinson | |
| 3,801,240 | A | | 4/1974 | Ruf | |
| 3,849,037 | A | | 11/1974 | Downs | |
| 3,853,440 | A | * | 12/1974 | Green | 418/142 |
| 3,875,634 | A | | 4/1975 | Minegishi | |
| 3,890,937 | A | | 6/1975 | Koivunen | |
| 3,891,357 | A | | 6/1975 | Davis et al. | |
| 3,899,272 | A | | 8/1975 | Pratt | |
| 3,924,979 | A | | 12/1975 | Rose | |
| 3,930,767 | A | | 1/1976 | Hart | |
| 3,932,075 | A | | 1/1976 | Jones | |
| 3,941,523 | A | * | 3/1976 | Shin et al. | 418/142 |
| 3,969,049 | A | | 7/1976 | Hermes et al. | |
| 3,976,406 | A | * | 8/1976 | Sasaki | 418/142 |
| 3,981,642 | A | * | 9/1976 | Kawamura et al. | 418/142 |
| 4,028,022 | A | * | 6/1977 | Takeuchi et al. | 418/104 |
| 4,047,856 | A | | 9/1977 | Hoffman | |
| 4,058,321 | A | * | 11/1977 | Gavrun et al. | 418/61.2 |
| 4,060,352 | A | | 11/1977 | Woodier et al. | |
| 4,102,617 | A | * | 7/1978 | Kato | 418/142 |
| 4,176,848 | A | | 12/1979 | Lafuze | |
| 4,225,294 | A | * | 9/1980 | Kakuwa et al. | 418/142 |
| 4,466,621 | A | | 8/1984 | Garner et al. | |
| 4,772,189 | A | | 9/1988 | Garside | |
| 6,186,510 | B1 | * | 2/2001 | Reagan | 277/371 |
| 2004/0164496 | A1 | | 8/2004 | Okada et al. | |
| 2012/0227397 | A1 | | 9/2012 | Willi et al. | |
| 2013/0028773 | A1 | * | 1/2013 | Gekht et al. | 418/61.2 |

* cited by examiner

OIL SEAL ARRANGEMENT FOR ROTARY INTERNAL COMBUSTION ENGINE

CROSS-REFERENCE TO RELATED APPLICATION

This application claims priority on provisional U.S. application No. 61/512,463 filed Jul. 28, 2011, the entire contents of which are incorporated by reference herein.

TECHNICAL FIELD

The application relates generally to an internal combustion engine using a rotary design to convert pressure into a rotating motion, more particularly, to an oil seal arrangement for such an engine.

BACKGROUND OF THE ART

Rotary engines such as the ones known as Wankel engines use the eccentric rotation of a piston to convert pressure into a rotating motion, instead of using reciprocating pistons. In these engines, the rotor includes a number of apex portions which remain in contact with a peripheral wall of the rotor cavity of the engine throughout the rotational motion of the rotor.

The eccentric rotary motion of the rotor is guided through a rotor phasing gear which is meshed with a stator phasing gear, and at least one oil seal is provided around the phasing gear to prevent oil from entering the combustion area. Double oil seal rings with radially spaced seals are typically provided in each end face of the rotor for improved sealing. However the rotor must be sufficiently large to accommodate this double oil seal while leaving sufficient room for the gas seals located radially outwardly thereof.

SUMMARY

In one aspect, there is provided a rotor of a rotary internal combustion engine, the rotor comprising a body having two axially spaced apart end faces and a peripheral face extending between the end faces, the peripheral face defining three circumferentially spaced apex portions, the body having a central bore for receiving an eccentric portion of a shaft therein, each of the end faces having an annular oil seal groove defined therein around the central bore, and an annular oil seal assembly snugly received within each oil seal groove, each oil seal assembly including a seal ring retaining first and second axially spaced apart annular sealing elements in substantial radial alignment with one another, the seal ring radially pressing each of the sealing elements in sealing engagement with a respective surface in the groove in opposite directions from one another, and a spring member biasing the seal ring axially away from the end face.

In another aspect, there is provided a rotary internal combustion engine comprising a stator body having an internal cavity defined by two axially spaced apart end walls and a peripheral wall extending between the end walls, the cavity having an epitrochoid shape defining two lobes, a rotor body having two axially spaced apart end faces each extending in proximity of a respective one of the end walls of the stator body, and a peripheral face extending between the end faces and defining three circumferentially spaced apex portions, the rotor body being engaged to an eccentric shaft to rotate within the cavity with each of the apex portions remaining adjacent the peripheral wall, each of the end faces having an annular oil seal groove defined therein around the eccentric shaft, and an annular oil seal assembly snugly received within each oil seal groove, each oil seal assembly including a seal ring retaining first and second axially spaced apart annular sealing elements in substantial radial alignment with one another, the seal ring radially pressing each of the sealing elements in sealing engagement with a respective surface in the groove in opposite directions from one another, and a spring member biasing the seal ring axially away from the end face.

In a further aspect, there is provided a method of limiting radially outwardly directed oil leaks between an end face of a rotor of a Wankel engine and an adjacent end wall of a stator of the engine, the method comprising providing an annular groove within each end face of the rotor around a shaft of the rotor, sealingly engaging a seal ring with a first axial surface within the groove at a first location and with second axial surface within the groove at a second location, the first and second locations being axially spaced apart from one another, and biasing the seal ring against the end wall.

DESCRIPTION OF THE DRAWINGS

Reference is now made to the accompanying figures in which.

DETAILED DESCRIPTION

Figure 1:
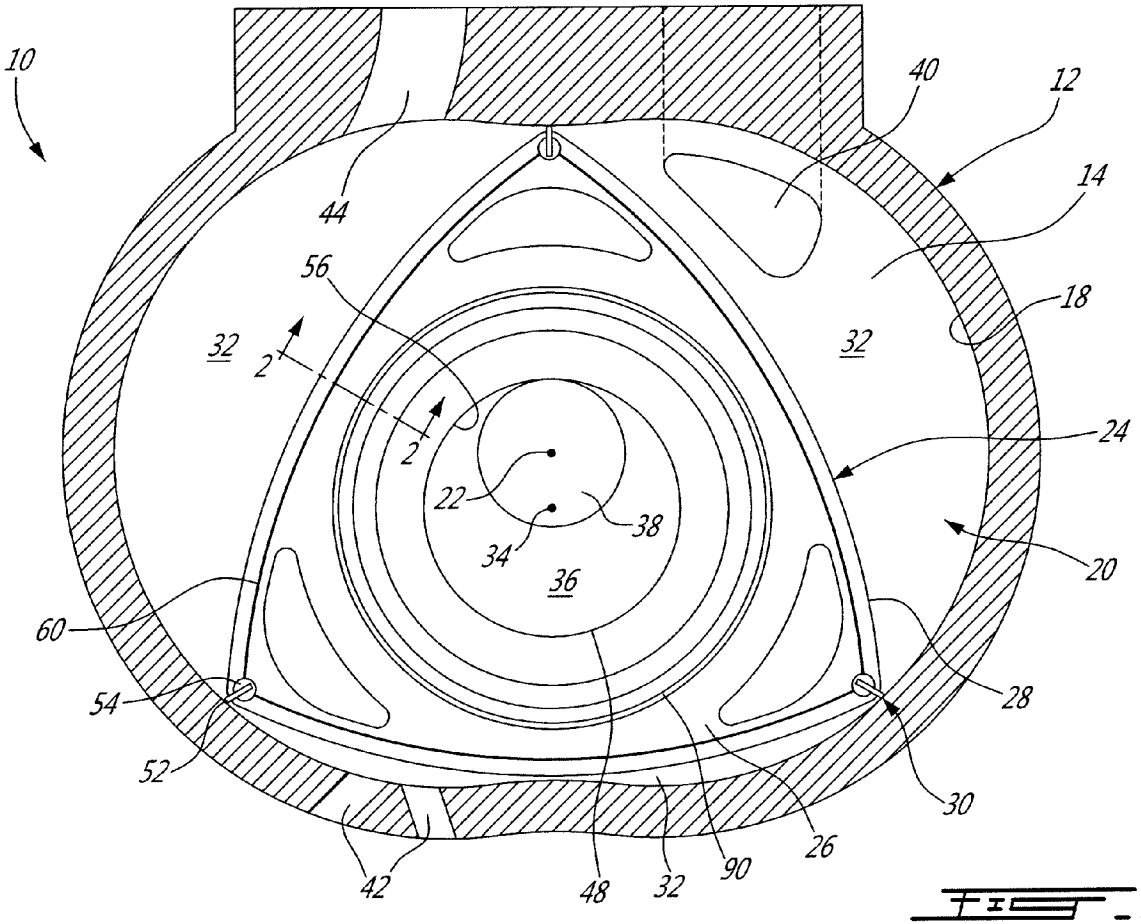
FIG. 1 is a schematic cross-sectional view of a rotary internal combustion engine in accordance with a particular embodiment.

Referring to FIG. 1, a rotary internal combustion engine 10 known as a Wankel engine is schematically shown. The engine 10 comprises an outer body 12 having axially-spaced end walls 14 with a peripheral wall 18 extending therebetween to form a rotor cavity 20. The inner surface of the peripheral wall 18 of the cavity 20 has a profile defining two lobes, which is preferably an epitrochoid.

An inner body or rotor 24 is received within the cavity 20. The rotor 24 has axially spaced end faces 26 adjacent to the outer body end walls 14, and a peripheral face 28 extending therebetween. The peripheral face 28 defines three circumferentially-spaced apex portions 30, and a generally triangular profile with outwardly arched sides. The apex portions 30 are in sealing engagement with the inner surface of peripheral wall 18 to form three working chambers 32 between the inner rotor 24 and outer body 12. The geometrical axis 34 of the rotor 24 is offset from and parallel to the axis 22 of the outer body 12.

In the embodiment shown, the outer body 12 is stationary while the rotor 24 is journaled on an eccentric portion 36 of a shaft 38, the shaft 38 being co-axial with the geometrical axis 22 of the cavity 20. Upon rotation of the rotor 24 relative to the outer body 12 the working chambers 32 vary in volume. An intake port 40 is provided through one of the end walls 14 for admitting air, or air and fuel, into one of the working chambers 32. Passages 42 for a spark plug or other ignition mechanism, as well as for one or more fuel injectors (not shown) are provided through the peripheral wall 18. An exhaust port 44 is also provided through the peripheral wall 18 for discharge of the exhaust gases from the working chambers 32. Alternately, the exhaust port 44 and/or the passages 42 may be provided through the end wall 14, and/or the intake port 40 may be provided through the peripheral wall 18.

During engine operation the working chambers 32 have a cycle of operation including the four phases of intake, compression, expansion and exhaust, these phases being similar to the strokes in a reciprocating-type internal combustion engine having a four-stroke cycle.

For efficient engine operation the working chambers 32 are sealed by apex seals, face seals and end seals.

Each rotor apex portion 30 has a groove defined therein and extending radially inwardly into the rotor body 24, from one end face 26 to the other. An apex seal 52 is received within each groove, and protrudes radially from the peripheral face 28. In a particular embodiment, each apex seal 52 extends axially beyond both end faces 26, and has an axial dimension which is as close as possible to a distance between the two end walls 14 of the cavity 20, taking into consideration the difference in thermal expansion between the material(s) of the outer body 12 and the material of the apex seal 52, which in a particular embodiment is made of a suitable type of ceramic. In the embodiment shown in FIG. 2, each apex seal 52 is monolithic, i.e. is formed of a single seal member. Alternately, each apex seal 52 may be formed of two or more cooperating seal members. More than one apex seal 52 may also be provided on each apex portion 30. Each apex seal 52 is biased radially outwardly against the peripheral wall 18 through a respective spring (not shown).

An end seal 54 is received within a respective cylindrical recess (not shown) defined at each end of the groove. Each end seal 54 has a radial slot defined therein, which receives the respective end of the apex seal 52. Each end seal 54 is biased against the respective end wall 14 through a suitable spring (not shown).

Each end face 26 of the rotor 24 has at least one groove 58 (see FIG. 2) defined therein running from each apex portion 30 to each adjacent apex portion 30, with a face seal 60 being received within each groove 58. In a particular embodiment, each face seal 60 is monolithic. Each face seal groove 58 and corresponding face seal 60 are arc-shaped and disposed adjacent to but inwardly of the rotor periphery throughout their length. A spring (not shown) located behind each face seal 60 urges it axially outwardly so that the face seal 60 projects axially away from the adjacent rotor end face 26 into sealing engagement with the adjacent end wall 14 of the cavity. Each face seal 60 is in sealing engagement with the end seal 54 adjacent each end thereof, for example by being received in a corresponding groove (not shown) defined in the end seal 54, or through abutment therewith. The end seals 54, face seals 60 and apex seals 52 thus cooperate to form a seal against the respective end wall 14.

Figure 2:
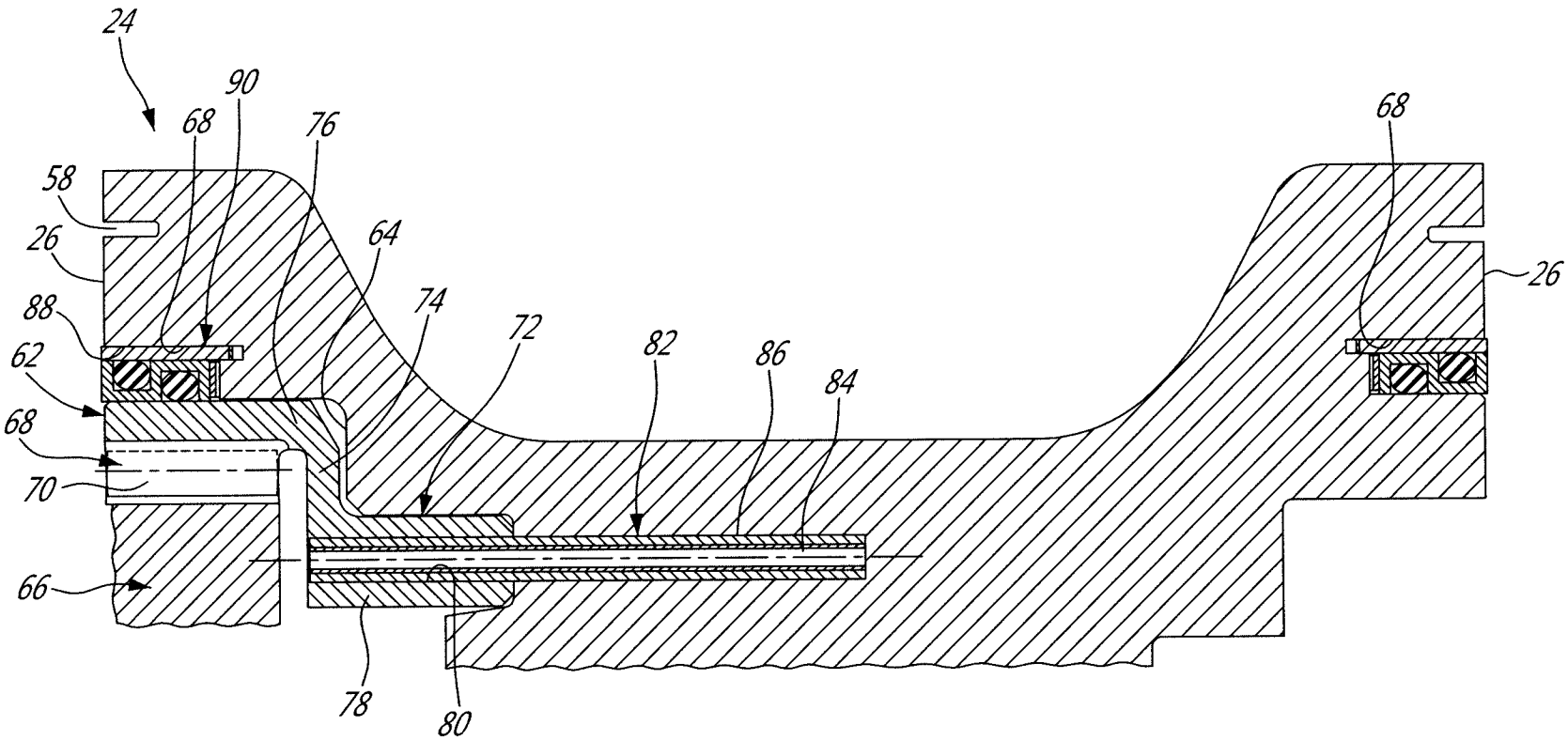
FIG. 2 is a schematic cross-sectional view taken along line 2-2 of FIG. 1.

Referring to FIG. 2, the rotor 24 includes a phasing gear 62 which is received in a complementary annular phasing gear groove 64 defined in one of the end faces 26. The phasing gear groove 64 is defined around and in proximity of the rotor's central bore 56 (see FIG. 1) which receives the eccentric portion 36 of the shaft 38. The rotor phasing gear 62 is secured in the gear groove 64 co-axially with the rotor axis 34, or in other words, with the central bore 56. The rotor phasing gear 62 is meshed with a fixed stator phasing gear 66 secured to the outer body 12 co-axially with the shaft 38, in order to maintain the relative motion of the inner rotor 24 relative to the stationary outer body 12.

The rotor phasing gear 62 includes an annular meshing section 68 coaxial with the rotor axis 34, which includes a plurality of radially inwardly oriented teeth 70 regularly distributed about a circumference thereof. The axially outer surface of the teeth 70 is in alignment or substantially in alignment with the portion of the end face 26 located radially outwardly of the phasing gear 62.

The rotor phasing gear 62 also includes an annular attachment section 72 which is connected to the meshing section 68 and coaxial therewith. The attachment section 72 is axially inwardly offset from the teeth 70 such as to leave sufficient room for the stator phasing gear 66 to mesh with the teeth 70.

The attachment section 72 includes a radial portion 74 extending radially inwardly from an axially inner end 76 of the meshing section 68 and an axial portion 78 extending axially inwardly from the radial portion 74, creating a substantially Z-shaped cross-section for the phasing gear 62. The axial portion 78 includes a plurality of axially extending and circumferentially spaced apart fastener bores 80 defined therethrough (only one of which is shown). Each bore 80 receives a fastener 82 therein, with the fasteners extending axially inwardly beyond the phasing gear 62 and into the body of the rotor 24 to a depth sufficient to adequately connect the phasing gear 62 to the rotor body 24.

The axial portion 78 is defined such that the bores 80 and as such the fasteners 82 received therein are located radially inwardly of the teeth 70. The teeth 70 and fasteners 82 are thus aligned with two different annular sections of the rotor body 24, with the section aligned with the fasteners 82 being defined radially inwardly of the section aligned with the teeth 70. In the embodiment shown, the entire axial portion 78 is located radially inwardly of the teeth 70.

In the embodiment shown, the fasteners 82 are split rivets which include an inner pin 84 press-fitted into the central bore of a hollow outer pin 86 to press-fit the rivet into the fastener bore 80. Alternately, other adequate type of fasteners can be used, such as for example bolts, blind rivets, solid and hollow rivets, etc.

The configuration of the rotor phasing gear 62 may advantageously allow for the radial size of the gear 62 to be minimized for a given diameter of the teeth 70, by eliminating the annular outer portion which would otherwise be required for an attachment along the outer diameter. As such, the same phasing gear 62 may be used with rotors having a smaller rotor face profile. The smaller phasing gear 62 may also allow for larger oil seals to be used with smaller rotors. The smaller phasing gear 62 may also leave more room for the combustion area for a given rotor, when compared to the same rotor using a phasing gear attached along its outer diameter, since the location of the fasteners usually define an inner limit for the combustion area Referring to FIGS. 2-3, each end face 26 includes an annular oil seal groove 88 defined therein around the central bore and located radially inwardly of the face seal grooves 58. An annular oil seal assembly 90 is snugly received within each oil seal groove 88. Each oil seal assembly 90 prevents leakage flow of the lubricating oil radially outwardly thereof between the respective rotor end face 26 and outer body end wall 14.

Figure 3:
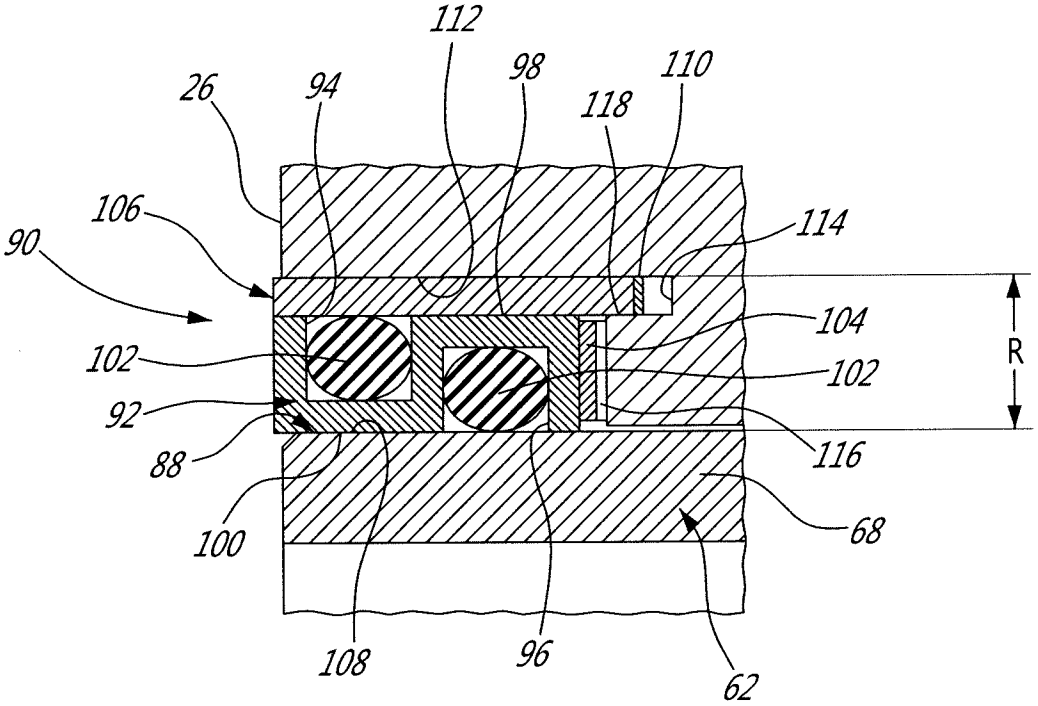
FIG. 3 is a schematic enlarged view of an oil seal assembly shown in FIG. 2.

As can be seen more clearly in FIG. 3, each oil seal assembly 90 includes an inner seal ring 92 protruding axially from the end face 26 and biased away from the end face by a spring member 104 which is received in the oil seal groove 88 axially inwardly of the seal ring 92. The seal ring 92 has axially spaced apart first and second circumferential slots 94, 96 defined therein. The first slot 94 opens in the radially outer surface 98 of the inner seal ring 92 while the second slot 96 opens in the radially inner surface 100 of the seal ring 92, thus defining a substantially S-shaped cross-section for the seal ring 92. In the embodiment shown, the first slot 94 is located axially outwardly of the second slot 96, and the slots 94, 96 have a rectangular cross-section. The inner seal ring 92 extends in contact with the radially inner surface 108 of the oil seal groove 88, which in the embodiment shown in defined by the radially outer surface of the meshing section 68 of the rotor phasing gear 62.

Each of the slots 94, 96 includes an annular sealing element 102, for example an o-ring, compressed therein. In a particular embodiment, the seal ring 92 is made of an adequate metal, for example steel, cast iron or an adequate type of super alloy, and the o-rings are made of a more flexible material, for example rubber or any adequate type of polymer such as a perfluoroelastomer (e.g. Kalrez™). The two sealing elements 102 are thus axially spaced apart and substantially radially aligned. For example, as can be seen in FIG. 3, the two axially spaced sealing elements 102 are positioned such as to overlap at least partially along the radial direction.

Each oil seal assembly 90 also includes an outer seal ring 106 protruding axially from the end face 26 and biased away from the end face by a spring member 110 received in the oil seal groove 88 axially inwardly of the outer seal ring 106. The outer seal ring 106 extends in contact with the radially outer surface 98 of the inner seal ring 92 and with the radially outer surface 112 of the oil seal groove 88. The outer seal ring 106 has an axially extending rectangular cross-section. In a particular embodiment, the inner and outer seal rings 92, 106 are made of a same material.

As such, the sealing element 102 contained in the first slot 94 is compressed between the inner and outer seal rings 92, 106 and forms a seal therebetween, while the sealing element 102 contained in the second slot 96 is compressed between the inner seal ring 92 and the radially inner surface 108 of the oil seal groove 88 and forms a seal therebetween.

In the embodiment shown, the outer seal ring 106 extends axially inwardly further than the inner seal ring 92. The oil seal groove 88 thus includes an outer section 114 and an inner section 116 separated by a shoulder 118, with the outer section 114 being defined axially deeper than the inner section 116. The outer section 114 is sized to snugly receive the outer seal ring 106 and corresponding spring member 110 therein with the outer seal ring 106 abutting the shoulder 118, and the inner section 116 is sized to snugly receive the inner seal ring 92 and corresponding spring member 104 therein.

In an alternate embodiment which is not shown, the outer seal ring 106 and corresponding spring member 110 are omitted, and the oil seal groove 88 includes a single section with the S-shaped inner seal ring 92 being received in contact with the radially inner and outer surfaces 108, 112 of the groove 88.

The two sealing elements 102 which are substantially radially aligned allows for a reduction of the radial envelope of the oil seal assembly 90 when compared to prior radially offset double seals. In a particular embodiment, the radial dimension R of the oil seal assembly 90 may be approximately 55% of the radial dimension of a typical combination of two radially spaced apart oil seals. Reduced radial dimension for the oil seals may allow for the use of a larger phasing gear or, as used with a reduced size phasing gear as shown, for a smaller rotor size for a given combustion area. This configuration may allow for double seals to be used on smaller rotors, when compared to prior radially spaced apart double seals. Although two oil seals are described, it may be desirable in some instances to provide more seals as described, and/or other oil sealing as well.

The phasing gear 62 and/or oil seal assembly 90, whether used separately or together, may also allow for the Wankel engine to have a more compact configuration and/or lower weight.

The above description is meant to be exemplary only, and one skilled in the art will recognize that changes may be made to the embodiments described without departing from the scope of the invention disclosed. For example, any suitable phasing gear arrangement may be employed. Modifications which fall within the scope of the present invention will be apparent to those skilled in the art, in light of a review of this disclosure, and such modifications are intended to fall within the appended claims.

The invention claimed is:

1. A method of limiting radially outwardly directed oil leaks between an end face of a rotor of a Wankel engine and an adjacent end wall of a stator of the engine, the method comprising:

providing an annular groove within the end face of the rotor around a shaft of the rotor;

inserting an outer seal ring within the annular groove;

sealingly engaging an inner seal ring in the annular groove with a first axial surface at a first location and with a second axial surface at a second location, the first and second locations being located within the same annular groove and being axially spaced apart from one another, the first axial surface being a radially inner surface of the outer seal ring; and biasing the inner and outer seal rings against the end wall.

2. The method as defined in claim 1, wherein the outer seal ring is inserted within the annular groove in contact with a radially outer surface of the groove.

3. The method as defined in claim 1, wherein the second axial surface is a radially outer surface of a phasing gear of the rotor.

4. The method as defined in claim 1, wherein sealingly engaging the seal ring with the first axial surface includes compressing a first annular sealing element between the seal ring and the first axial surface at the first location, and sealingly engaging the seal ring with the second axial surface includes compressing a second annular sealing element between the seal ring and the second axial surface at the second location.

5. A rotor of a rotary internal combustion engine, the rotor comprising:

a body having two axially spaced apart end faces and a peripheral face extending between the end faces, the peripheral face defining three circumferentially spaced apex portions, the body having a central bore for receiving an eccentric portion of a shaft therein, each of the end faces having an annular oil seal groove defined therein around the central bore; and an annular oil seal assembly snugly received within each oil seal groove, each oil seal assembly including a seal ring retaining first and second axially spaced apart annular sealing elements positioned such as to overlap at least partially along a radial direction of the body, the seal ring radially pressing each of the sealing elements in sealing engagement with a respective surface in the groove in opposite directions from one another, and a spring member biasing the seal ring axially away from the end face.

6. The rotor as defined in claim 5, wherein the seal ring has axially spaced apart first and second circumferential slots defined therein, the first slot opening in a radially outer surface of the seal ring and the second slot opening in a radially inner surface of the seal ring, the first annular sealing element being received in the first slot, and the second annular sealing element being received in the second slot.

7. The rotor as defined in claim 6, wherein the seal ring is a first seal ring and the spring member is a first spring member, each oil seal assembly further including a second seal ring extending in contact with the radially outer surface of the first seal ring and protruding axially from the end face, and a second spring member biasing the second seal ring axially away from the end face, the first sealing element being pressed against a radially inner surface of the second seal ring.

8. The rotor as defined in claim 7, wherein the second seal ring extends axially inwardly further than the first seal ring, the oil seal groove having a first section receiving the first seal ring and the first spring member therein, and a second section extending axially inwardly deeper than the first section and receiving the second seal ring and the second spring member therein.

9. The rotor as defined in claim 6, wherein the first slot is located axially outwardly of the second slot.

10. The rotor as defined in claim 5, wherein the first and second sealing elements are o-rings.

11. The rotor as defined in claim 5, wherein the seal ring is made of metal and the first and second sealing elements are made of a material more flexible than that of the seal ring.

12. The rotor as defined in claim 5, wherein on a first one of the end faces the oil seal groove is defined adjacent a phasing gear of the rotor such that a radially inner wall of the oil seal groove of the first end face is defined by a surface of the phasing gear, and the second seal element of the oil seal assembly located in the oil seal groove of the first end face is pressed against the surface of the phasing gear.

13. A rotary internal combustion engine comprising:

a stator body having an internal cavity defined by two axially spaced apart end walls and a peripheral wall extending between the end walls, the cavity having an epitrochoid shape defining two lobes;

a rotor body having two axially spaced apart end faces each extending in proximity of a respective one of the end walls of the stator body, and a peripheral face extending between the end faces and defining three circumferentially spaced apex portions, the rotor body being engaged to an eccentric shaft to rotate within the cavity with each of the apex portions remaining adjacent the peripheral wall, each of the end faces having an annular oil seal groove defined therein around the eccentric shaft; and an annular oil seal assembly snugly received within each oil seal groove, each oil seal assembly including a seal ring retaining first and second axially spaced apart annular sealing elements positioned such as to overlap at least partially along a radial direction of the rotor body, the seal ring radially pressing each of the sealing elements in sealing engagement with a respective surface in the groove in opposite directions from one another, and a spring member biasing the seal ring axially away from the end face.

14. The engine as defined in claim 13, wherein the seal ring has axially spaced apart first and second circumferential slots defined therein, the first slot opening in a radially outer surface of the seal ring and the second slot opening in a radially inner surface of the seal ring, the first annular sealing element being received in the first slot, and the second annular sealing element being received in the second slot.

15. The engine as defined in claim 14, wherein the seal ring is a first seal ring and the spring member is a first spring member, each oil seal assembly further including a second seal ring extending in contact with the radially outer surface of the first seal ring and protruding axially from the end face, and a second spring member biasing the second seal ring axially away from the end face, the first sealing element being pressed against a radially inner surface of the second seal ring.

16. The engine as defined in claim 15, wherein the second seal ring extends axially inwardly further than the first seal ring, the oil seal groove having a first section receiving the first seal ring and the first spring member therein, and a second section defined axially inwardly deeper than the first section and receiving the second seal ring and the second spring member therein.

17. The engine as defined in claim 14, wherein the first slot is located axially outwardly of the second slot.

18. The engine as defined in claim 13, wherein the first and second sealing elements are o-rings.

19. The engine as defined in claim 13, wherein the seal ring is made of metal and the first and second sealing elements are made of a material more flexible than that of the seal ring.

20. The engine as defined in claim 13, wherein on one of the end faces the oil seal groove is defined adjacent a rotor phasing gear connected to and coaxial with the rotor body, the rotor phasing gear being meshed with a stator phasing gear connected to and coaxial with the stator body, and the second seal element of the oil seal assembly located in the oil seal groove of the one of the end faces is pressed against a surface of the phasing gear.

* * * * *